United States Patent [19]

Garcia-Kuenzli

[11] 4,055,346

[45] Oct. 25, 1977

[54] TABLE WAR GAME APPARATUS

[76] Inventor: Marcos Garcia-Kuenzli, P.O. Box 2212, Hato Rey Station, San Juan, P.R. 00919

[21] Appl. No.: 673,469

[22] Filed: Apr. 5, 1976

[51] Int. Cl.[2] ..... A63F 3/04

[52] U.S. Cl. ..... 273/131 BB; 273/131 A; 273/131 AB; 273/134 B

[58] Field of Search ..... 273/131, 134, 137

[56] References Cited

U.S. PATENT DOCUMENTS

| | | | |
|---|---|---|---|
| 690,656 | 1/1902 | Lasker | 273/131 BB |
| 1,544,254 | 6/1925 | May et al. | 273/134 AC |
| 3,167,313 | 1/1965 | Davenport et al. | 273/137 AB |

*Primary Examiner*—Delbert B. Lowe
*Attorney, Agent, or Firm*—Fleit & Jacobson

[57] ABSTRACT

A game device providing simulation of air warfare between nations in which strategic-tactical maneuvers and stratagems occurring in actual air combat are used to obtain victory over an opponent. The game device includes a game board in the form of a map having irregularly shaped, discrete areas delineated thereon by perimeter lines and certain of the areas are distinguishable by color with such areas including those areas normally found on maps, such as cities, mountain areas, and the like. Positionable on these areas of the game board and movable thereon are a plurality of simulated jet aircraft and supporting platforms therefor with the platforms being provided in groups of distinguishable colors indicating flight altitude of the jet aircraft supported by that particular platform. In determining the results of various plays, a measuring device, designated a missile vector, is employed to indicate the results of the maneuvers during each player's turn in accordance with predetermined rules of play.

7 Claims, 8 Drawing Figures

TABLE WAR GAME APPARATUS

BACKGROUND OF THE INVENTION

1. Field of the Invention

The present invention generally relates to game devices and apparatuses and, more particularly, to that type of game device employing a game board and game pieces positioned on the game board and movable thereon by opposing players in accordance with a predetermined procedure embodied in the rules of play. The game board is in the form of a map, and the game pieces are in the form of simulated jet aircraft. The results of each play are determined by a measuring device in the form of a missile vector which enables the game to be utilized in simulation of tactical air warfare between nations.

2. Description of the Prior Art

Game devices of various types employing game boards, game pieces and control means for moving the game pieces and means for determining the results of such movement are well known in the prior art, including game devices of this type simulative of various types of combat, warefare, and the like, such as naval warfare, infantry warfare, desert fighting, and the like. However, such devices normally employ a chance-type control device such as dice, spinners, instructional cards, and the like, with the results of each play depending primarily upon the chance control device or a playing board in which the discrete areas are uniformly-shaped or are arranged in a uniform pattern for play. While such previous game devices are entertaining and successful to a certain degree, it is desirable in such devices to require the utilization of the skill of the players rather than merely chance control.

SUMMARY OF THE INVENTION

An object of the present invention is to provide a game device including a game board and game pieces positioned and movable thereon in which the game board is in the form of a map having delineated areas thereon and the game pieces are in the form of miniature simulated aircraft so that opposing players may utilize various maneuvers and stratagems in conducting simulated air tactical and strategic combat fighting in an effort to obtain victory over the opponent.

Another object of the invention is to provide a game device in accordance with the preceding object in which each of the simulated aircraft is provided with a detachable supporting platform with the game device including a plurality of groups of platforms of distinguishable colors which indicate the flight altitudes of the aircraft which they support.

Still another object of the invention is to provide a game device in accordance with the preceding objects in which the designated areas of play are irregularly-shaped over the game board.

A further object of the invention is to provide a game device in accordance with the preceding objects in which a measuring device, designated as a missile vector, is provided for determining the results of the maneuvers of the opposing players during each turn when playing the game.

A still further object of the invention is to provide a game device in accordance with the preceding objects in which portions of the designated areas of the game board are provided with distinguishable colors designating cities, mountains, normal terrain, and the like, in order to simulate actual topographical conditions which may be encountered in air warfare.

Yet another important object of the present invention is to provide a game device requiring the utilization of the skill of the players in determining the flight characteristics, maneuvers, and the like, of their aircraft during each turn, thereby enabling development of tactical skills relating to air warfare and providing a game device which is educational as well as entertaining.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
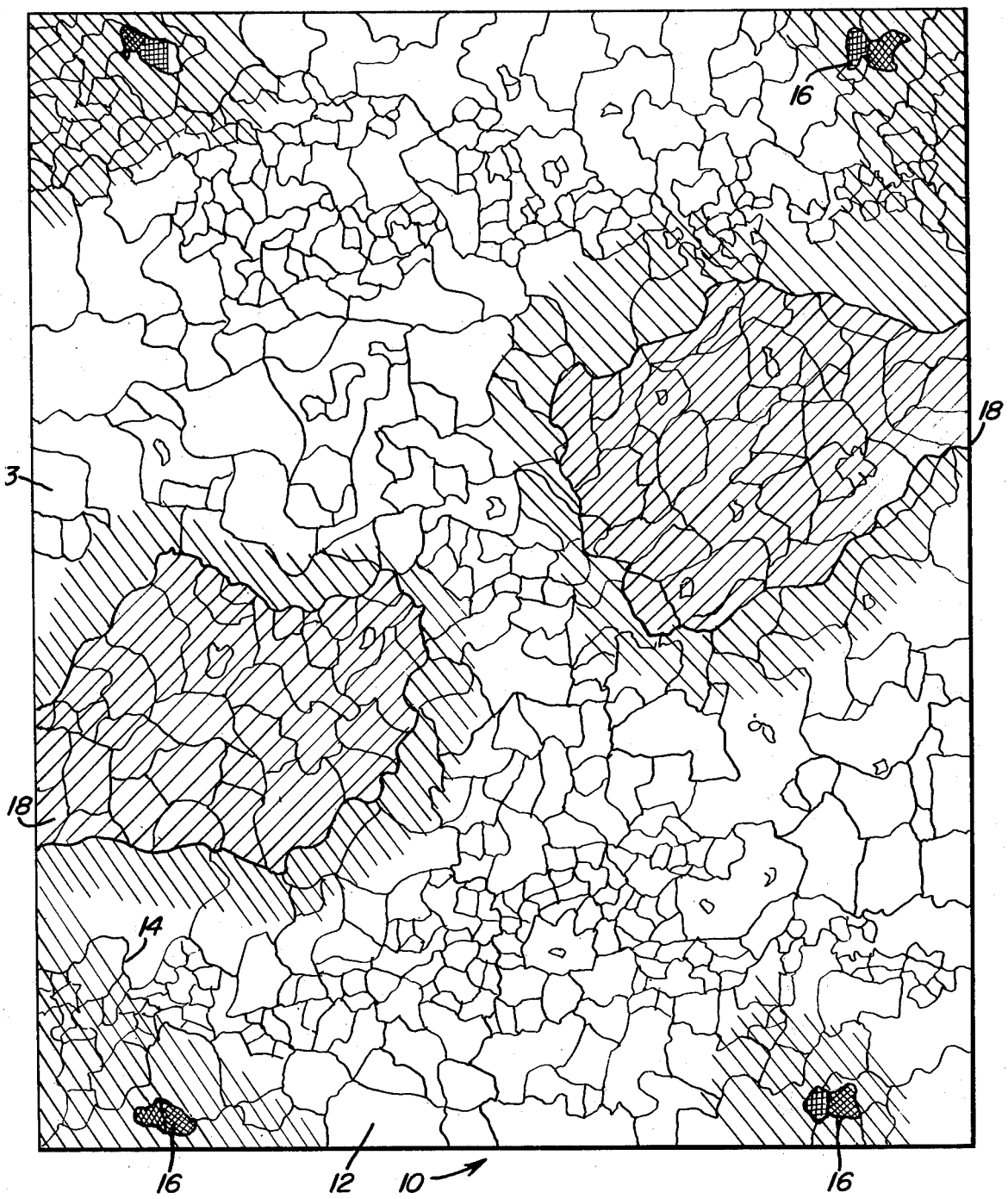
FIG. 1 is a plan view of the game board of the game device.
Figure 2:
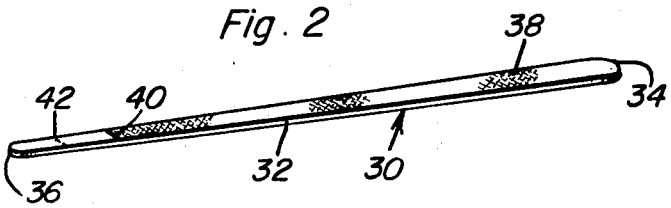
FIG. 2 is a perspective view of the missile vector.
Figure 3:
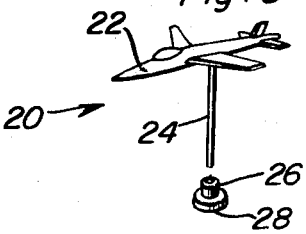
FIG. 3 is a perspective view of one of the simulated miniature jet aircraft and its supporting platform.

FIG. 1 of the drawings illustrates a game board 10 of rectangular configuration, although it may be of any suitable shape and size, with the board being provided with a planar upper surface 12 and constructed of heavy cardboard, paperboard, or any other suitable material, having sufficient rigidity similar to known game boards. The board may be provided with a central hinge structure in the form of fabric or paper tape, or the like, to enable the game board to be folded in half to facilitate packaging in a suitable container, or the like.

The planar upper surface 12 is provided with indicia thereon in the form of boundary or perimeter lines 14 which delineate discrete areas 13 on the surface 12 in which the discrete areas are irregular in shape and oriented in an irregular pattern, with some areas being relatively large and other areas being relatively small, but with all areas being contiguous. The major portion of the surface area 12 is provided with a single color, as designated by the shading in FIG. 1, such as green. Adjacent each corner of the game board, two adjacent, relatively small areas 16 are left white or colored another distinguishable color, and crosshatched to indicate cities. In the central area of the planar playing surface 12, a large group of adjacent areas 18 are colored a distinctive color, such as brown, and designate mountain areas with the two areas 18 being spaced from each other in the central portion of the playing surface and extending to the outside perimeter of the side edges of the playing surface 12 as illustrated in FIG. 1. Thus, the game board 10 and its playing surface 12 define a map representing a geographical area which includes a plurality of cities, mountains, and areas indicating countryside, small villages, and the like, such as would be normally found in a geographical area. The indicia and distinguishable colors may be placed on the game board in any suitable manner, such as by employing conventional printing techniques, and the like.

A plurality of game pieces 20 are provided for positioning on and movement on the game board with each game piece including a miniature simulated jet aircraft 22 in the form of a fighter. The aircraft 22 includes a depending pin or peg 24 which is telescopically and removably received in an upwardly opening socket 26 in the upper end of a supporting platform 28 which is in the form of a circular member having a flat bottom surface and an upstanding reduced cylindrical portion on the top surface in which the socket 26 is formed. The aircraft 22 is constructed preferably of plastic, although it can be constructed of other materials, and the platform 28 is also constructed of plastic with the pin or peg 24 being preferably metal, although other materials may be employed, with the plastic material of the platform 28 serving to frictionally secure itself to the pin 24 to retain the platform 28 assembled with the pin 24 and aircraft 22. The aircraft 22 are provided in two groups of distinguishable colors, such as four blue aircraft and four silver aircraft. Groups of distinguishably colored platforms also will be provided with there being nine silver platforms, nine blue platforms, nine yellow platforms, nine red platforms, nine orange platforms, nine white platforms and nine black platforms. The two groups of aircraft 22 will be assigned to the opposing players for identification purposes and each of the colored platforms will designate the flight altitude of the aircraft which it supports in a manner described hereinafter.

A measuring device is provided which is named a missile vector and is generally designated by the numeral 30. The missile vector includes an elongated, relatively narrow member 32 of stiff cardboard, plastic, wood, or the like, having rounded ends 34 and 36 with the sides of the member 32 converging from the wider rounded end 34 to the narrower rounded end 36. The major portion of the length of the measuring device or missile vector is provided with a distinguishable color 38 terminating at a transverse line 40 adjacent to but spaced from the rounded tip end 36. Intermediate the transverse line 40 and the rounded tip end 36 is a transverse broken line 42 which is easily observable since the surface of the member 32 between the transverse line 40 and the rounded tip end 36 may be left white or some other distinguishable color to enable the transverse broken line 42 to be easily observed. The length of the member 32 may approximate the over-all length of five aircraft 22 and, since it is used to determine the outcome of play, the measuring device or missile vector 30 is normally kept out of view of the players during their turns.

To start the paly of the game, opponents are assigned the two disguishably colored groups of aircraft so that they may recognize their aircraft. Each of the jet aircraft is initially provided with a silver platform indicating that the jet aircraft flight altitude, is say, 10,000 feet. The other platforms will indicate higher flight altitudes with the blue platforms indicating, for example, 20,000 feet, yellow platforms indicating 30,000 feet, red platforms indicating 40,000 feet, orange platforms indicating 50,000 feet, while platforms indicating 60,000 feet and black platforms indicating 70,000 feet. When the game is started, the opponents will place their aircraft on the areas 16 designating the cities, with all four jet aircraft having silver platforms indicating a flight altitude of 10,000 feet. Also, the four city areas, forming two cities, on one side of the game board will be assigned to one player or team of players and the two cities on the other side of the game board will be assigned to the other player or team of players. Also, at the beginning of the game, each opponent will determine and designate the altitude at which its two cities are vulnerable to be bombed by enemy aircraft, with this bombing altitude varying from 10,000 feet up to 70,000 feet, and each city may have a different bombing vulnerability. However, the bombing altitude vulnerability of each city as stipulated by the players will cover both areas of that particular city. The game starts, after the players decide which player is to begin, by moving aircraft around the map on the game board by various maneuvers allowed by the rules of play. The turn of the players may be selected by chance or by any other means.

In playing a game designated "Interceptor", accurate utilization of speed, height, distance, and missile firing capabilities are employed in close simulation of actual air tactical combat fighting and the game represents a state of war between two nations in which their respective supersonic jet Air Forces try to obtain victory over the opponent. The simulated aircraft are able to perform like real jets by means of flying alternatives which allow each aircraft to maneuver and fly over the game board, engaging in tactics, maneuvers, and stratagems of interception, bombing of cities and the like. Each jet aircraft will maneuver and move through the areas on the game board in any desired direction by means of the flying alternatives and will gain or lose altitude and/or move into or through the various areas. Each jet aircraft will be able to engage in interception procedures, my making attacking-approaches against enemy aircraft, with it being understood that in this game firing a missile occurs every time that an attacking-approach is conducted by an aircraft. To determine if the missile has hit or missed its target, the missile vector 30 is used. Bombing of an opponent's cities occurs when enemy aircraft fly over one of them at the altitude stipulated for that city by the players. When playing the game, the two nations or opponents will maneuver their jet aircraft with the purpose in mind of intercepting and attacking all opponent jet aircraft and shooting them down, destroying the opponent's cities by bombing and defending their own cities from a bomb attack by enemy aircraft.

When playing the game, a player's turn takes place when he (1) flies all of his aircraft using at least one flying alternative per aircraft, and/or (2) engages in interception or attacking-approach, if desired, and uses the missile vector to determine the combat results, and/or (3) engages in a correct interception or attacking-approach by using the missile vector, and utilizes extra flying alternatives, if desired, and again uses the missile vector to determine the combat results, if these extra flying alternatives were used to make new attacking-approaches, and/or (4) engages in bombing procedure, if desired, and/or (5) combines the different maneuvers mentioned above, but always maneuvering all of his aircraft. An opponent will not be able to defend himself or fire back at the enemy until his turn comes.

Each jet aircraft of each player is allowed from one to six flying alternatives during a turn. The flying alternatives may be used to gain altitude, lose altitude and/or fly into or through the areas printed on the game board. Each aircraft may be moved in any direction of the game board. Every aircraft must use at least one flying alternative during each turn and unused flying alternatives will not accumulate nor will they pass on from one aircraft to another.

Regardless of the size of the area, when an aircraft moves through or into an area, it uses one of its six flying alternatives. If the aircraft flies through six areas, it will have used up all its flying alternatives. In order to be able to place an aircraft on the same area with another one, the standing platforms of each aircraft must be placed partially or completely within the same area. There are some areas that are too small in size for such placement, and in these situations, only one jet aircraft can occupy the specific area at a time. In order to avoid a collision, jet aircraft belonging to the same player can fly in the same area provided that they are flying at different altitudes. However, when the aircraft flying in the same area are enemies, they are allowed to fly at the same or different altitudes without incurring a collision.

An aircraft also has the alternative of gaining or losing altitude in brackets of 10,000 feet, and every time an aircraft gains or loses 10,000 feet it uses one of its flying alternatives. While moving into or through the areas of the game board, an aircraft may at the same time gain or lose altitude.

Examples of using the flying alternatives are (1) an aircraft may climb from 10,000 feet up to 50,000 feet and then move through two areas, (2) climb from 10,000 feet up to 70,000 feet and stay in the same area, (3) go through six areas at the same altitude, (4) descend from 70,000 feet to 20,000 feet and move into one area. In each instance above, all six flying alternatives have been used. It is not necessary to use all six alternatives but in each turn each aircraft must use at least one of its six flying alternatives and, of course, each aircraft can use no more than six flying alternatives.

The mountain areas 18 shaded in brown have a minimum flying altitude of, say, 40,000 feet. Therefore, flying through a mountain area under 40,000 feet will be considered a crash. An opposing player may call out a crash only after his opponent has completed moving all of his aircraft and before he starts using the missile vector to determine the combat results if there are any to be resolved. In the case of a crash, the aircraft is removed from the game and considered lost.

When using flying alternatives during a turn, a player may use an interception procedure in the form of an attacking-approach which is a tactical procedure through which any aircraft approaches an enemy aircraft, using up to six of its flying alternatives and ending up at the same flying altitude of the attacked enemy aircraft and firing a missile. It is pointed out that firing a missile occurs each time that an attacking-approach is carried out by an aircraft. The missile vector 30 is used to determine if a missile has hit or missed its target or the attacking aircraft has made an improper attacking-approach. However, the missile vector is used only after each of the remaining aircraft of the attacking player has used at least one of its six flying alternatives. Also, each aircraft has unlimited fire power and, therefore, can attack as many times as desired during the game. A player does not have to attack with all or any of his aircraft during his turn since he may, if desired, just move the aircraft around without attacking. Also, various aircraft may attack the same enemy aircraft at the same time. However, an aircraft cannot use its attacking-approach to shoot at two different enemy aircraft at the same time.

The missile vector is a measuring device to measure the distance between the two fighting aircraft and determine whether the attacking aircraft has made an improper attacking-approach or a correct attacking-approach, thereby achieving a miss or a kill when firing its missile.

Figure 4:
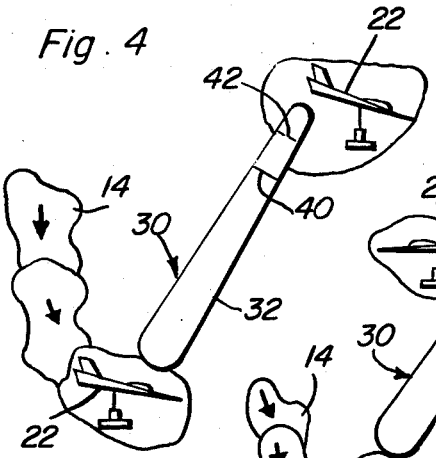
FIGS. 4–8 illustrate certain maneuvers and results including use of the missle vector in determining the outcome of the game.
Figure 5:
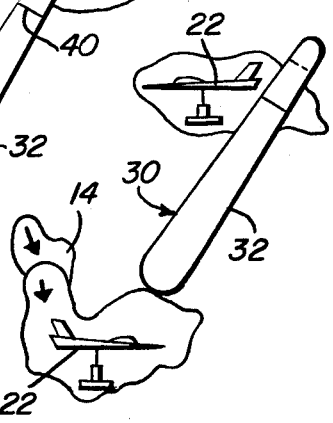
Figure 6:
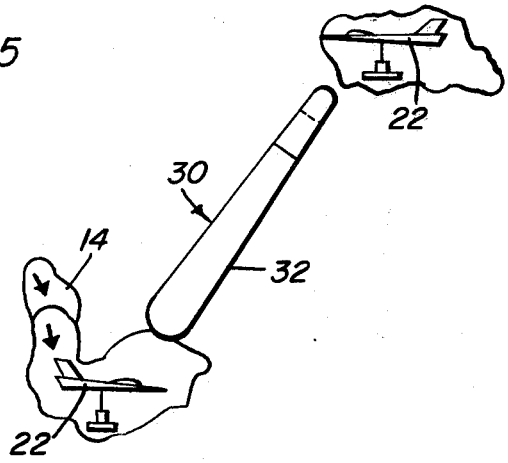
Figure 7:
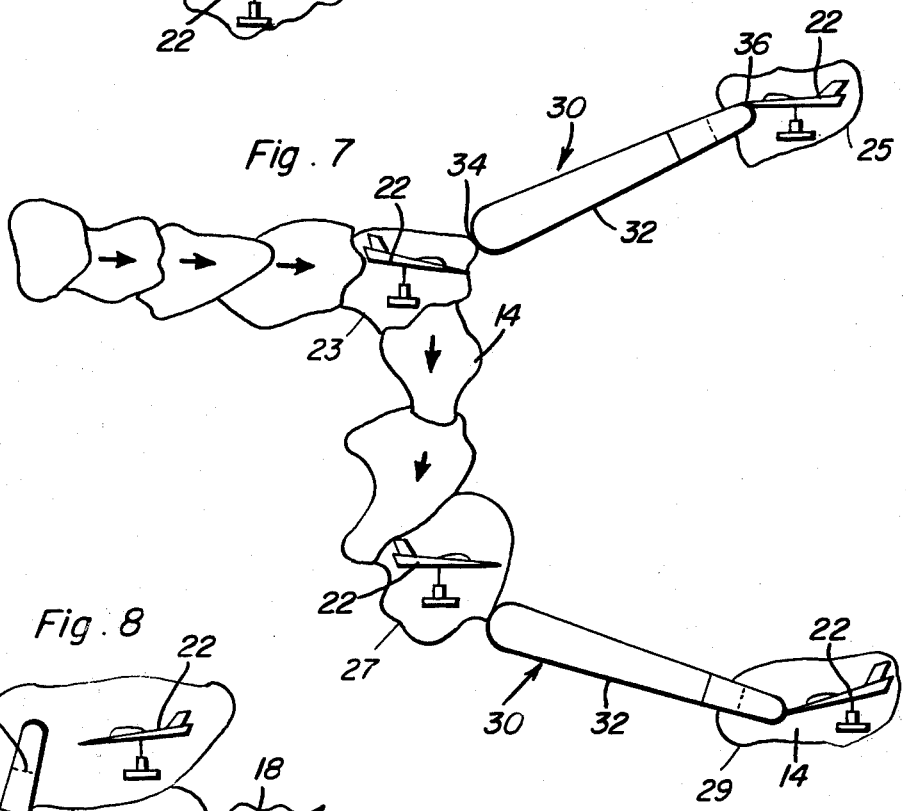

As illustrated in FIGS. 4–8, when the missile vector is placed on the game board, the shaded end of the vector will be placed on the edge of the area where the attacking aircraft is located and it must be placed on the border line that is nearest to the area where the enemy aircraft is standing. The unshaded end of the vector must be pointed toward the area where the attacked enemy aircraft is standing. If the dotted line 42 on the unshaded part of the missile vector falls within any part of the area where the attacked enemy aircraft is standing, the attacking aircraft has fired its missiles and achieved a kill and the attacked enemy aircraft must be removed from the game. FIG. 4 illustrates such an arrangement in which the attacking aircraft has moved, as indicated by the arrows, to an area in relation to the area in which the attacked aircraft stands so that when the missile vector is used in accordance with the above procedure, the dotted line 42 falls within the area on which the attacked aircraft stands, thus indicating a correct attacking-approach and a hit or kill. If the broken line 42 on the missile vector falls outside of the area on which the attacked aircraft stands, such as beyond the area as illustrated in FIG. 5, then the missile fired is a miss. However, if the unshaded part of the missile vector falls within any part of the area where the attacked enemy aircraft is standing, regardless if there has been a hit or a miss, a correct attacking-approach has been made. In other words, FIG. 5 illustrates a correct attacking-approach, but a missed fired missile. Where the attacking aircraft carries out a correct attacking-approach, irrespective of hit or miss, the attacking aircraft can use the extra flying alternatives, if desired. If, on the other hand, the area where the attacked enemy aircraft is standing does not fall within the unshaded area of the missile vector, then the attacking aircraft has made what is called an improper attacking-approach, in which event the attacking aircraft cannot use extra flying alternatives. FIG. 6 illustrates an improper attacking-approach since the tip end 36 of the missile vector falls short of the area on which the attacked enemy aircraft is standing. In the event of an improper attacking-approach, the attacking aircraft is not entitled to extra flying alternatives.

Extra flying alternatives represent six additional flying alternatives allowed to each aircraft engaged in a correct attacking-approach. The extra flying alternatives are used only after the aircraft that has engaged in a correct attacking-approach has fired its missiles and used the missile vector to determine that the unshaded part falls within any part of the area where the attacked enemy aircraft is standing. The extra flying alternatives are used, if desired, for relocation of the attacking aircraft, bombing of cities and/or to make attacking-approaches on different enemy aircraft. If a decision is made to make new attacking-approaches on new enemy targets, the aircraft may be moved again up to six alternatives and the missile vector used again to determine if there has been a miss of a kill. On the other hand, the extra flying alternatives can be used for relocation to move the attacking aircraft away from danger. However, it must be kept in mind that after making use of the extra flying alternatives for either new attacking-approaches or relocation, the aircraft must remain still, thus ending that player's turn. In the arrangement illustrated in FIG. 7, the aircraft has first moved to area 23 and fired at an enemy aircraft in area 25. Although a "miss", the attacking aircraft has made a correct attacking-approach, thereby entitling it to move by extra flying alternatives to area 27 where it makes a second attacking-approach on another enemy aircraft in area 29, which is a "hit". A "missed" enemy aircraft cannot be attacked a second time by the attacking aircraft with the extra flying alternatives.

If one or more attacking aircraft intercept one or more enemy aircraft and miss on their attacking-approach but the attacking-approach is a correct one, the attacking aircraft can switch targets and fire at the new target using the extra flying alternatives. In the case where an enemy aircraft is intercepted by more than one attacking aircraft at the same time, each of the attacking aircraft, if a correct attacking-approach has been made, can use extra flying alternatives, regardless of whether either of the attacking aircraft hit or missed.

Figure 8:
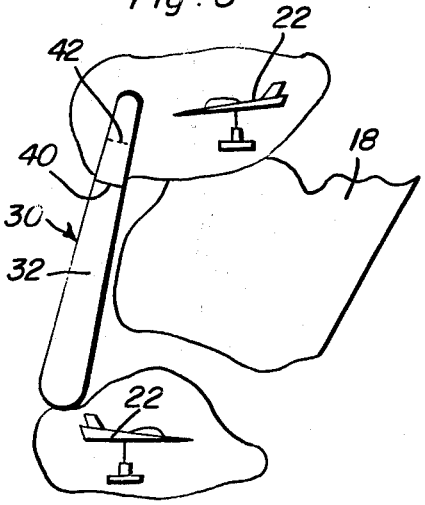

Aircraft will not be able to make an attacking-approach in or across mountain areas 18 at an altitude lower than 40,000 feet as illustrated in FIG. 8. When mountains partially block the areas where the aircraft in conflict are flying at an altitude lower than 40,000 feet, the missile vector will be placed from the nearest border line where no interference occurs so that, as illustrated in FIG. 8, the missile vector can indicate a correct attacking-approach and a kill or miss, as the case may be.

An aircraft may bomb and destroy city areas by flying over each of the city areas at the altitude stipulated by the player for each city prior to the start of the game. Each area occupied by a city may be bombed by the same or different aircraft in the same or different turns. An aircraft can make an attacking-approach to an enemy aircraft, or any other maneuver, and at the same time consider a city bombed because it flew over it at the altitude stipulated by the city. When a player has shot down all of its opponent's aircraft or has destroyed by bombing both cities assigned to the opponent, a victory has been won and the game is over.

As an alternative to physical missile vector measurements, this game can also be played electrically and/or with a computer by programming all the possibilities of the missile vector when placed on the border line of every area of the game board, so that the necessity of physically placing the missile vector to measure distances would be avoided. Further, it is also contemplated that the concepts of this game can be incorporated in other wartype environments, such as submarine warfare, or the like.

By using the game device and rules of play outlined previously players will utilize and thus develop skills relating to aircraft speed, altitude, distance relationships and missile firing as well as various maneuvers and tactics relating to air warfare or combat.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A game device comprising a game board having a generally planar playing surface, a map of a geographical area depicted on said playing surface by indicia, a plurality of irregularly-shaped discrete areas delineated on the playing surface by perimeter lines defining the boundaries of the areas, said discrete areas being of varying shape whereby the distance between any one perimeter line of one area and any one perimeter line of another area is varied, said areas being contiguous with certain groups of areas being distinguishably colored to designate obstruction areas and target areas, and a plurality of game pieces positionable on the game board with each game piece having a supporting platform positionable on the various discrete areas on the game board to enable the game pieces to be moved along the game board, the platforms being distinguishably colored to indicate the vertical position of the game piece supported by a platform.

2. The structure as defined in claim 1 wherein the game pieces further comprise miniature aircraft, and means for detachably supporting said miniature aircraft on the supporting platform whereby differently colored platforms can be interchanged with the miniature aircraft, the obstruction areas and target areas represent mountain areas and cities, respectively, and the color system of the platform indicates the flight altitude of the aircraft supported by a platform.

3. A game device comprising a game board having a generally planar playing surface, a map of a geographical area depicted on said playing surface by indicia, a plurality of irregularly-shaped discrete areas delineated on the playing surface by perimeter lines defining the boundaries of the areas, said areas being contiguous, with certain groups of areas being distinguishably colored to designate obstruction areas and target areas, the obstruction areas and target areas representing mountain areas and cities, respectively, and a plurality of game pieces positionable on the game board with each game piece having a supporting platform positionable on the various discrete areas on the game board to enable the game pieces to be moved along the game board, the platforms being distinguishably colored to indicate the vertical position of a game piece supported by that platform, wherein the game pieces are miniature aircraft, and the color system of the platforms indicate the flight altitude of the aircraft supported by the platform, wherein the aircraft are separated into two groups which are distinguishably colored to be used by opponents playing a game with an equal number of areas designated as cities being assigned to each player, whereby the aircraft may attack the aircraft of opponents or bomb cities of opponents by maneuvering aircraft to change altitude by utilizing differently colored platforms and by moving from area to area during each player's turn in which a predetermined number of actions may be taken by each aircraft, and a measuring device means for determining whether an attacking aircraft has properly approached an attacked aircraft by determining whether the distance between the area of the attacking aircraft and the area of the attacked aircraft is between a first and a second distance, and for determining whether a missile fired by the attacking aircraft hits or misses the attacked aircraft by determining whether the distance between the area of the attacking aircraft and the area of the attacked aircraft is between said first distance and a third distance which is between the first and second distances.

4. The structure as defined in claim 3 wherein said measuring device means includes an elongated narrow member having a predetermined length constituting said first distance and indicia thereon positioned at one end portion of the member, said indicia including a transverse line designating said second distance, said member indicating an improper approach when said end portion thereof falls out of the area in which the attacked aircraft stands when the opposite end of the member is positioned against the nearest portion of the boundary line for the area on which the attacking aircraft stands, said indicia indlucing a second transverse line disposed centrally in the end portion and designating said third distance.

5. The structure as defined in claim 4 further comprising means for detachably supporting said miniature aircraft on the supporting platform whereby differently colored platforms can be interchanged with the miniature aircraft to designate different flight altitudes of aircraft with each change in flight altitude of each aircraft constituting an action and each movement of an aircraft into or out of one of the discrete areas constituting an action, thus enabling the aircraft to be maneuvered in any direction and to change altitude when maneuvering to attack another aircraft, pass over or around mountain areas and attack cities by passing over the area occupied by the cities.

6. The structure as defined in claim 5 wherein the areas of the game board designated as cities are defined by two contiguous areas said two contiguous areas having cross-hatched perpendicular indicia lines thereon.

7. An air warfare game device comprising a game board having a geographical area depicted thereon with target areas assignable to opposing players, said geographical area being divided into a plurality of irregularly shaped contiguous areas by perimeter lines with certain of the areas constituting the target areas, a plurality of simulated aircraft assignable to opposing players with the aircraft having distinguishable characteristics for recognition, each of said aircraft having changeable means associated therewith to indicate the flight altitude of the aircraft, measuring device means for determining whether an attacking aircraft has properly approached an attacked aircraft by determining whether the distance between the area of the attacking aircraft and the area of the attacked aircraft is between a first and a second distance, and for determining whether a projectile fired from the attacking aircraft hit or missed the attacked aircraft by determining whether the distance between the area of the attacking aircraft and the area of the attacked aircraft is between said first distance and a third distance which is between the first and second distances.

* * * * *